US010507516B2

(12) United States Patent
Tanaka

(10) Patent No.: US 10,507,516 B2
(45) Date of Patent: Dec. 17, 2019

(54) METHOD OF PRODUCING CASTING MOLD AND CASTING MOLD

(71) Applicant: ASAHI YUKIZAI CORPORATION, Nobeoka-Shi (JP)

(72) Inventor: Yuichiro Tanaka, Niwa-Gun (JP)

(73) Assignee: Asahi Yukizai Corporation, Nobeoka-Shi (JP)

( * ) Notice: Subject to any disclaimer, the term of this patent is extended or adjusted under 35 U.S.C. 154(b) by 351 days.

(21) Appl. No.: 15/347,005

(22) Filed: Nov. 9, 2016

(65) Prior Publication Data

US 2017/0050236 A1 Feb. 23, 2017

Related U.S. Application Data

(63) Continuation of application No. PCT/JP2015/067303, filed on Jun. 16, 2015.

(30) Foreign Application Priority Data

Jun. 20, 2014 (JP) ..... 2014-127177

(51) Int. Cl.

| | |
|---|---|
| ***B22C 1/18*** | (2006.01) |
| ***B22C 1/10*** | (2006.01) |
| ***B22C 9/02*** | (2006.01) |
| ***B22C 9/12*** | (2006.01) |

(52) U.S. Cl.

CPC ..... *B22C 1/188* (2013.01); *B22C 1/10* (2013.01); *B22C 9/02* (2013.01); *B22C 9/123* (2013.01)

(58) Field of Classification Search

CPC .. B22C 1/188; B22C 1/10; B22C 9/02; B22C 9/123

See application file for complete search history.

(56) References Cited

U.S. PATENT DOCUMENTS

| | | | | |
|---|---|---|---|---|
| 6,139,619 | A * | 10/2000 | Zaretskiy | B22C 1/18 106/629 |
| 6,299,677 | B1 | 10/2001 | Johnson et al. | |
| 2008/0099180 | A1 | 5/2008 | Weicker et al. | |
| 2010/0294454 | A1 | 11/2010 | Muller et al. | |
| 2011/0139309 | A1 | 6/2011 | Showman et al. | |
| 2015/0231691 | A1 | 8/2015 | Tanaka | |
| 2016/0361756 | A1 | 12/2016 | Deters et al. | |

FOREIGN PATENT DOCUMENTS

| | | | |
|---|---|---|---|
| CN | 101259515 | A | 9/2008 |
| CN | 101610862 | A | 12/2009 |
| CN | 102762512 | A | 10/2012 |
| CN | 102971098 | A | 3/2013 |
| DE | 10 2007 045649 | A1 | 4/2009 |
| EP | 2 937 160 | A1 | 10/2015 |
| GB | 1087767 | A | 10/1967 |
| GB | 1165949 | A | 10/1969 |
| JP | 2000-513272 | A | 10/2000 |
| JP | 2005-066634 | A1 | 3/2005 |
| JP | 2008-511447 | A1 | 4/2008 |
| JP | 2010-506731 | A1 | 3/2010 |
| JP | 2012-076114 | A | 4/2012 |
| JP | 2012-076115 | A | 4/2012 |
| JP | 2013-094834 | A | 5/2013 |
| JP | 2013-244502 | A | 12/2013 |
| JP | 2014-065049 | A1 | 4/2014 |
| JP | 2014-117740 | A1 | 6/2014 |
| WO | 2006/058664 | A2 | 6/2006 |
| WO | 2015/058737 | A2 | 4/2015 |

OTHER PUBLICATIONS

International Search Report and Written Opinion (Application No. PCT/JP2015/067303) dated Aug. 4, 2015.

Extended European Search Report, European Application No. 15810580.9, dated Jan. 22, 2018 (15 pages).

Chinese Office Action (with English translation), Chinese Application No. 201580033410.9, dated Mar. 2, 2018 19 pages).

Japanese Office Action (with English translation), Japanese Application No. 2016-529372, dated May 7, 2019 (12 pages).

* cited by examiner

*Primary Examiner* — Kevin P Kerns
*Assistant Examiner* — Steven S Ha
(74) *Attorney, Agent, or Firm* — Burr & Brown, PLLC

(57) ABSTRACT

Purposes of the present invention are to provide a dry coated sand having a high degree of fluidity at the room temperature, a method of advantageously producing the coated sand, and a method of producing a casting mold having excellent properties, by using the coated sand. The dry coated sand is obtained by mixing an aqueous solution of a water glass used as a binder, with a heated refractory aggregate, whereby water in the aqueous solution is evaporated, and a coating layer of the binder is formed on surfaces of the refractory aggregate. A moisture percentage in the thus obtained dry coated sand is controlled so as to be not more than 0.5% by mass. The intended casting mold is obtained by filling a molding cavity of a forming mold, with the dry coated sand, and passing a steam through the coated sand, to solidify or cure the coated sand.

18 Claims, No Drawings

METHOD OF PRODUCING CASTING MOLD AND CASTING MOLD

This application is a continuation of the International Application No. PCT/JP2015/067303 filed on Jun. 16, 2015, the entireties of which are incorporated herein by reference.

BACKGROUND OF THE INVENTION

Field of the Invention

The present invention relates to a method of producing a casting mold, and the casting mold. More particularly, the invention relates to a method of producing a casting mold using a molding material mixture in a dry state or a wet (moisture) state, and a casting mold produced by the method.

Description of Related Art

As one type of a method of producing a casting mold used for casting a molten metal, the method of forming self-curing molds by using inorganic binders like a water glass as a binder has been disclosed. However, the casting mold formed by using the inorganic binder consisting of the water glass suffers from deterioration of its strength due to moisture absorption, resulting in a defect of a poor moisture-resistant strength of the casting mold. Thus, the casting mold has a problem of difficulty of its use in a highly humid environment. Even though there are some kinds of a water glass which have a good moisture-resistant strength, these kinds of water glass tend to be poor in formability. Accordingly, conditions of such available water glass may be limited, so that measures to improve both of the formability and the moisture-resistant strength are desired.

In view of the above, JP-A-2008-511447 suggests one of the methods of producing a mold material by using a fine particulate material formed by mixing a heat-curable binding composition as an inorganic binder. The method disclosed in this document uses at least one refractory mold raw material and a molding mixture for producing a metal processing mold including at least a binder based on a water glass. To the molding mixture, a particulate metal oxide, which is selected from the group consisting of silicon dioxide, aluminum oxide, titanium oxide and zinc oxide, is added at a predetermined ratio. Addition of the particulate metal oxide is considered to provide advantages of an improvement of initial strength of a mold, namely the strength of the mold immediately after removal from a hot device, and an improvement of the moisture resistance.

However, such molding mixture hardly exhibits an effect of improvement of the moisture resistance where the metal oxide is used in a small amount, so that it is necessary to add the metal oxide in the amount larger than that of a solid content of the water glass. For this reason, such molding mixture does not solve the problem of deterioration of formability, even though it may improve the moisture-resistant strength. In particular, a silicon dioxide causes generation of free silicic acid in a step of mixing of foundry sand or in a step of reclaiming of waste foundry sand, with the free silicic acid resulting in deterioration of the working environment, or even a harmful effect to the respiratory organs of the human body. Furthermore, although the molding mixture permits a short-term improvement of the moisture resistance, it cannot sufficiently solve the problem that the strength of the casting mold decreases with a passage of time due to moisture absorption, in the case where the casting mold is held in a highly humid atmosphere for a long time, for example. Specifically, in the case where the formation of the casting mold is performed at a temperature of 200° C. or lower, even conventional additives for improving the moisture resistance do not permit a sufficient strength of the mold subjected to moisture absorption.

SUMMARY OF THE INVENTION

The present invention was made in view of the background art described above. Therefore, it is a problem to be solved by the present invention to provide an improved method of producing a casting mold, which permits an improvement of the moisture-resistant strength of the casting mold using an inorganic binder consisting of a water glass. Another problem to be solved by the present invention is to provide a casting mold produced by the method.

In order to solve the above-described problems, the present invention can be preferably embodied in various modes which will be described below. The various modes of the invention described below may be practiced in any combination. It is to be understood that the modes and technical features of the present invention are not limited to those described below, and can be recognized based on the inventive concept disclosed in the specification taken as a whole.

(1) A method of producing a casting mold, wherein a molding material mixture comprising at least (a) a refractory aggregate, (b) a binder including a water glass as an essential component and (c) a carbonate and/or a borate is filled and held within a forming mold heated to a temperature of 120° C.-200° C., so that the molding material mixture is cured.

(2) A method of producing a casting mold, wherein a molding material mixture comprising at least (a) a refractory aggregate, (b) a binder comprising a water glass as an essential component and (c) a carbonate and/or a borate is filled into and held within a forming mold so as to be solidified or cured, and then the molding material mixture is subjected to a secondary baking at a temperature of 120° C.-200° C.

(3) The method of producing the casting mold according to the above-described mode (2), wherein the forming mold is heated to a temperature of not lower than 30° C. and lower than 120° C.

(4) The method of producing the casting mold according to any one of the above-described modes (1) to (3), wherein a heated air or a heated steam is passed through the forming mold while the molding material mixture is held within the forming mold (5) The method of producing the casting mold according to any one of the above-described modes (1) to (4), wherein the carbonate and/or the borate is used in an amount of 1-50 parts by mass with respect to 100 parts by mass of the water glass.

(6) The method of producing the casting mold according to any one of the above-described modes (1) to (5), wherein the water glass comprises a sodium silicate as a major component.

(7) The method of producing the casting mold according to the above-described mode (6), wherein the sodium silicate has a molar ratio $SiO_2/Na_2O$ of 1.5-4.0.

(8) The method of producing the casting mold according to any one of the above-described modes (1) to (7), wherein the carbonate is at least one of zinc carbonate, ferrous carbonate, manganese carbonate and copper carbonate.

(9) The method of producing the casting mold according to any one of the above-described modes (1) to (8), wherein the borate is at least one of sodium tetraborate, potassium tetraborate, lithium tetraborate, ammonium tetraborate, calcium tetraborate, strontium tetraborate, silver tetraborate, sodium metaborate, potassium metaborate, lithium metaborate, ammonium metaborate, calcium metaborate, silver metaborate, copper metaborate, lead metaborate and magnesium metaborate.

(10) The method of producing the casting mold according to any one of the above-described modes (1) to (9), wherein the molding material mixture is in a wet state.

(11) The method of producing the casting mold according to any one of the above-described modes (1) to (9), wherein the molding material mixture is in a dry state, and a steam is passed through a filling phase of the molding material mixture after the molding material mixture is filled within the forming mold.

(12) A casting mold produced by a method wherein a molding material mixture comprising at least (a) a refractory aggregate, (b) a binder including a water glass as an essential component and (c) a carbonate and/or a borate is filled and held within a forming mold heated to a temperature of 120° C.-200° C., so that the molding material mixture is cured.

(13) A casting mold produced by a method wherein a molding material mixture comprising at least (a) a refractory aggregate, (b) a binder comprising a water glass as an essential component and (c) a carbonate and/or a borate is filled and held within a forming mold so as to be solidified or cured, and then the molding material mixture is subjected to a secondary baking at a temperature of 120° C.-200° C.

In the present invention, the water glass is used as the binder, and an aqueous solution of the water glass is added to a refractory aggregate to form the casting mold. A molding material mixture is prepared by using carbonate and/or borate with the water glass and mixing them with the refractory aggregate so as to form the casting mold, while the casting mold is subjected to curing at a high temperature of 120° C.-200° C., so that the desired casting mold is obtained. Thus, the casting mold excellent in the moisture resistance is advantageously provided. Furthermore, the following advantages are achieved: the casting mold does not suffer from reduction of its strength when subjected to moisture absorption, long-term preservation of the molding material mixture and the casting mold is permitted, and so on.

DETAILED DESCRIPTION OF THE INVENTION

The molding material mixture used in the invention is classified according to its water content: the molding material mixture with the water content less than 0.5% by mass is classified as the one in a dry state; and the molding material mixture with the water content not less than 0.5% by mass is classified as the one in a wet or moisture state. The molding material mixture in the dry state is used as a coated sand formed by coating a refractory aggregate with a binder together with carbonate and/or borate. Meanwhile, although the molding material mixture in the dry state per se is not adhesive, the water glass (a coating layer) on the surface of the aggregate is dissolved by passing a steam or the like, so that the molding material mixture is rendered wet, and is solidified or cured by drying with heat. The molding material mixture in the wet state is in the form of an adhesive sand containing water, and such wet molding material mixture is subjected to a forming step, and then drying step by heat application so as to be solidified or cured.

The refractory aggregate constituting the molding material mixture is a refractory material which serves as a base material of the casting mold (a casting sand). Any one of various refractory particulate materials conventionally used for the casting mold may be used as the refractory aggregate. Specific examples of the refractory aggregate include: a silica sand; a regenerated silica sand; special sands such as an alumina sand, an olivine sand, a zircon sand and a chromite sand; slag particles such as a ferrochromium slag, a ferronickel slag and a converter slag; porous particles such as alumina particles and mullite particles, and regenerated particles thereof; an alumina ball; and a magnesia clinker. The above-indicated refractory aggregates may be: a new or fresh sand; a regenerated or reclaimed sand which has been used once or a plurality of times as a molding sand to form the casting mold; or a mixture of the regenerated or reclaimed sand and the new or fresh sand. The refractory aggregate used in the present invention generally has a grain size of about AFS 40-80, and preferably not larger than about AFS 60 in order to make it easy to pass a steam through the coated sand and dry the coated sand in the formation of the casting mold.

The water glass used as the binder of the molding material mixture according to the present invention is a soluble silicate compound, such as sodium silicate, potassium silicate, sodium metasilicate, potassium metasilicate, lithium silicate, ammonium silicate, colloidal silica and alkyl silicate. In the present invention, sodium silicate is advantageously used, since the molding material mixture obtained by using sodium silicate is not likely to suffer from blocking and has a high degree of formability. Sodium silicates are generally classified into No. 1 to No. 5 based on their $SiO_2/Na_2O$ molar ratios. Specifically described, the sodium silicate No. 1 has the molar ratio $SiO_2/Na_2O$ within a range between 2.0 and 2.3, the sodium silicate No. 2 has the molar ratio $SiO_2/Na_2O$ within a range between 2.4 and 2.5, the sodium silicate No. 3 has the molar ratio $SiO_2/Na_2O$ within a range between 3.0 and 3.3, the sodium silicate No. 4 has the molar ratio $SiO_2/Na_2O$ within a range between 3.3 and 3.5, and the sodium silicate No. 5 has the molar ratio $SiO_2/Na_2O$ within a range between 3.6 and 3.8. Among these, the sodium silicates No. 1 to No. 3 are also specified in JIS K1408. Any one or a mixture of the above-indicated sodium silicates may be used in the present invention. It is possible to control the molar ratio $SiO_2/Na_2O$ by mixing an additive such as sodium hydroxide and the like.

In the present invention, the sodium silicate used as the binder preferably has the molar ratio $SiO_2/Na_2O$ within the range from 1.5 to 4.0, and more preferably within the range from 1.8 to 3.0, in order to obtain the molding material mixture which can fill the molding cavity with a particularly high filling density and which can give the casting mold having a high degree of the strength. It goes without saying that it is possible to form and use a sodium silicate having a molar ratio outside the range according to the above-described classification.

In the case where the molar ratio in sodium silicate described above is lower, a larger amount of alkali in the water glass is permitted to exist, so that the casting mold more easily suffers from deterioration due to moisture absorption because of increased water solubility of the binder. Thus, a higher molar ratio is preferable for improving the moisture resistance, while an excessively high molar ratio results in decrease of a physical strength of the casting mold. It is desired to balance the moisture resistance and the physical strength of the casting mold. Considering the above, it is further preferred that the molding material mixture in the wet state has the molar ratio $SiO_2/Na_2O$ within the range from 2.5 to 3.0 in sodium silicate. Meanwhile, unlike the molding material mixture in the wet state, the molding material mixture in the dry state requires a step of passing a steam when forming the casting mold. By using the water glass having a lower molar ratio and containing a larger amount of alkali in the step, the binder on the surface of a sand particle dissolves into the steam more easily, so that the binder on the entire sand can be dissolved evenly and the formability of the casting mold is improved. Thus, it is further preferred that the molding material mixture in the dry state has the molar ratio $SiO_2/Na_2O$ within the range from 2.0 to 2.5, which ratio is lower than that of the molding material mixture in the wet state. For the above reasons, the present invention does not use the water glass having the predetermined same molar ratio but preferably uses the water glass having a different molar ratio depending upon whether the molding material mixture is in the wet state or in the dry state.

The aqueous solution of the water glass used in the present invention is obtained by dissolving the water glass in water. A commercially available aqueous solution of the water glass is used as an undiluted solution, as purchased, or as a diluted solution obtained by adding water to the undiluted solution. A solid content in the aqueous solution, which is obtained by subtracting amounts of volatile substances such as the water and a solvent contained in the aqueous solution from an amount of the aqueous solution, is called a nonvolatile content and corresponds to an amount of the soluble silicate compound such as the sodium silicate described above. A higher ratio of the nonvolatile content (solid content) in the aqueous solution indicates a higher concentration of the water glass in the aqueous solution. Where the aqueous solution of the water glass consists solely of the undiluted solution, the nonvolatile content in the aqueous solution corresponds to an amount of a portion of the undiluted solution other than the water contained therein. On the other hand, where the diluted solution obtained by diluting the undiluted solution with the water is used as the aqueous solution of the water glass, the nonvolatile content in the aqueous solution corresponds to an amount of a portion of the aqueous solution other than the water contained in the undiluted solution and the water used to dilute the undiluted solution.

The nonvolatile content in the aqueous solution of the water glass is adequately selected depending on the kind of the water glass, for example, but preferably held within a range of 20-45% by mass. Where an adequate amount of a water glass component corresponding to the nonvolatile content is contained in the aqueous solution, the surfaces of the refractory aggregate can be evenly and uniformly coated with the water glass component, when the refractory aggregate and the aqueous solution of the water glass are mixed (kneaded) together. As a result, the casting mold having high degrees of flexural strength and hardness or resistance to scratching of its surface can be advantageously produced. Where an excessively small amount of the water glass component is contained in the aqueous solution of the water glass such that a total amount of the nonvolatile content is less than 20% by mass, there arise the following problems: with respect to the molding material mixture in the dry state, it is necessary to dry the molding material mixture at a higher temperature for a longer period of time, so that there arises a problem of energy loss, for example; and with respect to the molding material mixture in the wet state, there arises a problem of a prolonged time required for the formation of the casting mold. Furthermore, where the ratio of the nonvolatile content in the aqueous solution of the water glass is excessively high, with respect to the molding material mixture in the dry state, it is difficult to uniformly coat the surfaces of the refractory aggregate with the water glass component, and a larger amount of the lumps are generated, giving rise to problems in improving properties of the casting mold. On the other hand, with respect to the molding material mixture in the wet state, the amount of the water content which contributes to the bond between the sands decreases, resulting in deterioration of the strength of the casting mold. Therefore, the aqueous solution of the water glass is preferably prepared such that the nonvolatile content in the aqueous solution is not more than 45% by mass with respect to the molding material mixture both in the dry state and in the wet state.

The coating layer of the water glass is formed on the surfaces of the refractory aggregate by using the aqueous solution of the water glass preferably in an amount of 0.1-2.5 parts by mass, and particularly advantageously in an amount of 0.2-2.0 parts by mass, in terms of the solid content or the nonvolatile content in the aqueous solution, per 100 parts by mass of the refractory aggregate. Here, the solid content in the aqueous solution of the water glass is measured in a manner described below: 10 g of a sample of the aqueous solution is weighed and put in a sample dish (a length: 90 mm; a width: 90 mm; a depth: 15 mm) formed of an aluminum foil; the sample dish is held on a heating plate whose temperature is held at 180±1° C., for 20 minutes; the sample dish is reversed upside down and held on the heating plate for 20 minutes; the sample dish is removed from the heating plate and cooled within a desiccator; then the sample is weighed. The solid content is calculated according to the following formula:

Solid content (%)=[Amount (g) of the sample after drying/Amount (g) of the sample before drying]×100

Where the aqueous solution of the water glass is used in an excessively small amount, it is difficult to effectively form the coating layer of the water glass on the surfaces of the refractory aggregate, so that it is difficult to sufficiently solidify or cure the molding material mixture. On the other hand, where the aqueous solution of the water glass is used in an excessively large amount, an extra amount of the aqueous solution adheres to the surfaces of the refractory aggregate, so that it is difficult to uniformly form the coating layer, and there arises a risk of difficulty in removing the molding sand of a core from a casting product after casting of a metal.

The binder used in the invention including the water glass described above as an essential component is contained in the molding material mixture in combination with at least one of a carbonate and a borate. In particular, examples of carbonate include zinc carbonate, ferrous carbonate, manganese carbonate and copper carbonate and the like. Among them, zinc carbonate is preferably used. Examples of borate include sodium tetraborate, potassium tetraborate, lithium tetraborate, ammonium tetraborate, calcium tetraborate, strontium tetraborate, silver tetraborate, sodium metaborate, potassium metaborate, lithium metaborate, ammonium metaborate, calcium metaborate, silver metaborate, copper metaborate, lead metaborate and magnesium metaborate and the like. Among them, sodium tetraborate and potassium metaborate are preferably used. Furthermore, the above carbonates and borates may be used alone or as a mixture of a plurality of kinds of them. The molding material mixture comprising the above carbonates or borates is filled and held within the forming mold heated to the temperature of 120° C.-200° C., or is filled and held within the heated forming mold, so as to be solidified or cured, and the solidified or cured molding material mixture is subjected to the secondary baking or heating at the temperature of 120° C.-200° C., so that the moisture-resistant strength of the obtained casting mold can be improved advantageously.

Generally, the total amount of use of the carbonates and/or borates is preferably 1-50 parts by mass, more preferably 1-20 parts by mass, and further preferably 2-10 parts by mass, with respect to 100 parts by mass of the solid content of the aqueous solution of the water glass calculated on the basis of only the nonvolatile portion. It is preferred that the amount of use is not less than 1 part by mass so that the effect of addition of the carbonates and/or borates is achieved. On the other hand, an excessive amount of addition of the carbonates and/or borates hinders bonding by the binder, giving rise to the problem of deterioration of the physical strength. Therefore, it is preferred that the amount of use is not more than 50 parts by mass.

In the present invention, the above-described carbonates and/or borates are combined with the binder including the water glass as an essential component, and are mixed with the predetermined refractory aggregate, so as to form the molding material mixture. To form the molding material mixture, various known methods which permit uniform mixing of the three components can be adequately selected. For example, the following methods can be applied: a method in which the binder and the carbonates and/or borate are combined with each other in advance, and then kneaded or mixed with the refractory aggregate; and a method in which the carbonates and/or borates are first added to the refractory aggregate separately from the binder, and then the binder is combined with the refractory aggregate so that the thus obtained mixture is uniformly kneaded or mixed. In particular, the latter method in which the carbonates and/or borates are mixed with the refractory aggregate in advance is advantageously applied, because the carbonates and/or borates used in the present invention have a solid powder form.

Various known additives can be included, as necessary, in the molding material mixture obtained as described above. In particular, examples of the additives to be added as necessary include a solid oxide, a salt, a carbohydrate and a surfactant. Among them, the solid oxide and the salt can advantageously improve the moisture resistance of the molding material mixture. As the solid oxide, an oxide of silicon, zinc, magnesium, aluminum, calcium, lead and boron can be effectively used. In particular, a metal oxide such as zinc oxide and aluminum oxide is preferred. As the silicon oxide, a precipitated silica and a pyrogenic silica is preferably used. As the salt, silicofluoride salts, silicates and phosphates can be used. And among them, phosphates are preferred in particular. As the carbohydrate, oligosaccharide, polysaccharide, cellulose, starch and dextrin are preferably used. Furthermore, as the surfactant, an anionic surfactant having a sulfate, sulfonate or phosphate group is preferably used. The above-indicated solid oxide, salt and the like are generally used in an amount of preferably 0.5-5 parts by mass, more preferably 1-3 parts by mass in particular, with respect to 100 parts by mass of the solid content of the aqueous solution of the water glass calculated on the basis of only the nonvolatile portion.

Further, it is effective to use, as other additives, coupling agents which strengthen a bond between the refractory aggregate and the water glass (binder). Examples of the coupling agents include silane coupling agents, zirconate coupling agents and titanate coupling agents. Also, it is effective to use lubricants which serve to improve the fluidity of the molding material mixture. Examples of the lubricants include: waxes such as paraffin wax, synthetic polyethylene wax and montan wax; fatty acid amides such as stearic acid amide, oleic acid amide, and erucic acid amide; alkylene fatty acid amides such as methylenebis stearic acid amide and ethylenebis stearic acid amide; stearic acid; stearyl alcohol; metal stearate; lead stearate; zinc stearate; calcium stearate; magnesium stearate; glyceryl monostearate; stearyl stearate; and hydrogenated oils. Further, it is possible to use mold releasing agents such as paraffins, waxes, light oils, machine oils, spindle oils, insulating oils, waste oils, plant oils, fatty acid esters, organic acids, graphite particulates, mica, vermiculite, fluorine-based mold releasing agents, and silicone-based mold releasing agents. The above-indicated additives other than the above-described solid oxides and salts are generally used in an amount of 0.001-5 parts by mass, more preferably 0.01-3 parts by mass in particular, with respect to 100 parts by mass of the solid content of the aqueous solution of the water glass calculated on the basis of only the nonvolatile portion.

The additives which do not react with the binder (water glass) and which are easy to be mixed with the binder can be combined with the binder in advance and then added to the refractory aggregate. The additives which react with the binder and which are difficult to be mixed with the binder are preferably added to and combined with the refractory aggregate separately from the binder.

Meanwhile, the molding material mixture produced by the method according to the present invention may be either in the dry state or in the wet state.

The molding material mixture in the dry state is produced by a method of uniformly kneading or mixing the binder combined with carbonates and/or borates and further with the additives as necessary, with the heated refractory aggregate, such that the surfaces of the refractory aggregate are coated with the binder, and the water in the aqueous solution of the water glass, which is a binding component of the binder, is evaporated, whereby the molding material mixture in the dry state having fluidity at the room temperature is obtained. The water in the aqueous solution of the water glass should be rapidly evaporated, in the presence of carbonates and/or borates, before solidification or curing of the water glass proceeds. Accordingly, in the present invention, the water in the aqueous solution of the water glass is evaporated within five minutes, and preferably within three minutes, after the aqueous solution is added to (mixed with) the refractory aggregate, to obtain the molding material mixture in the dry state.

As effective means for rapidly evaporating the water in the aqueous solution of the water glass, the above-described method of producing the molding material mixture according to the present invention includes the steps of: preheating the refractory aggregate; and kneading or mixing the preheated refractory aggregate with the aqueous solution of the water glass. By kneading or mixing the aqueous solution of the water glass with the preheated refractory aggregate, the water in the aqueous solution can be extremely rapidly evaporated by the heat of the refractory aggregate, whereby the moisture percentage of the obtained molding material mixture is effectively reduced, so that the dry granules having fluidity at the room temperature are advantageously obtained. A temperature to which the refractory aggregate is preheated is adequately selected depending on the water content in the aqueous solution of the water glass and the amount of use of the aqueous solution, for example. It is desirable to preheat the refractory aggregate to a temperature of generally about 100-150° C., and preferably about 100-120° C. Where the preheating temperature of the refractory aggregate is excessively low, the water cannot be effectively evaporated, so that a time required for drying the coated sand is undesirably increased. Therefore, it is desirable to preheat the refractory aggregate to a temperature not lower than 100° C. On the other hand, where the refractory aggregate is preheated to an excessively high temperature, curing of the water glass proceeds while the obtained molding material mixture is cooled, and the composite particles are formed, so that the molding material mixture has problems in terms of its function, particularly in its strength or other physical properties.

The molding material mixture according to the present invention is produced as described above, such that the moisture percentage of the molding material mixture in the dry state is controlled so as to be less than 0.5% by mass, and preferably not more than 0.3% by mass, whereby the molding material mixture can more easily fill the molding cavity of the forming mold used for producing the casting mold, and the casting mold formed by using the molding material mixture is given excellent properties.

On the other hand, the molding material mixture in the wet state is produced by a method of uniformly kneading or mixing the binder combined with carbonates and/or borates and further with the additives as necessary, with the refractory aggregate at the room temperature, such that the surfaces of the refractory aggregate are coated with the binder, whereby the molding material mixture in the wet state is obtained. The molding material mixture according to the present invention is produced as described above, such that the moisture percentage of the molding material mixture in the wet state is controlled in a range of not less than 0.5% by mass, and preferably 0.5-5.0% by mass, further preferably 1.0-3.0% by mass, whereby the sand in the wet state does not suffer from drying and blocking due to a blowing air used when the sand is filled into the forming mold during the formation of the casting mold, so that the moisture of the molding material mixture in the wet state is maintained, and the casting mold formed by using the molding material mixture is given excellent properties. Meanwhile, the molding material mixture in the wet state is required to be in the wet state at the time of production of the casting mold. Accordingly, the molding material mixture in the dry state, for example, can be used for the molding material mixture in the wet state by addition of water before its usage. In view of transferability and long-term storage, it is preferred that the molding material mixture is in the dry state except when the casting mold is produced. The amount of the water added to the molding material mixture in the dry state is preferably 1-5 part(s) by mass with respect to 100 parts by mass of the molding material mixture in the dry state.

According to the first method of forming the desired casting mold using the molding material mixture thus obtained according to the present invention, the above molding material mixture in the wet state is filled into a forming cavity of a forming mold which provides the desired casting mold, while the forming mold is heated to a temperature of 120-200° C. The molding material mixture filled into the forming mold is held within the forming mold until it is dried. The molding material mixture heated and held within the forming mold is thus subjected to solidification or curing.

As described above, the molding material mixture in the wet state is filled and held within the preheated forming mold, specifically, its molding cavity. Since the molding material mixture constituting the filling phase is in the wet state, the sand particles of the molding material mixture are bonded to each other so as to form a mass of the molding material mixture (a mass of the bonded particles of the molding material mixture) in the form of an integral casting mold. Meanwhile, the water glass, which is a major component of the binder, is usually solidified due to its water evaporation to dryness, or is cured in the case where an oxide or a salt is added as a curing agent. In the present invention, carbonates and/or borates are added as the curing agent, whereby the molding material mixture is cured in the filling phase. However, it is completely acceptable that the molding material mixture is only solidified.

The molding material mixture in the wet state is held within the forming mold for a predetermined period of time, which forming mold is preheated to and kept at the temperature of 120-200° C., so that the molding material mixture is dried due to the water evaporation to dryness and is solidified or cured. The temperature of preheating at which the forming mold is kept is 120-200° C., preferably 130-180° C., more preferably 140-160° C., and further preferably 145-160° C. The temperature is required to be not lower than 120° C. in order to expedite drying and shorten a length of time required for the formation of the mold, and to improve the moisture-resistant strength by the additives. On the other hand, the temperature is required to be not higher than 200° C. in order to prevent the problem that the water is evaporated before the bond between the sand particles is formed sufficiently, with a result of failure of the mold to exhibit the desired strength. The temperature of preheating within the above indicated range permits an improvement of the moisture-resistant strength of the casting mold, and an advantageous progress of drying of the molding material mixture.

As described above, the molding material mixture is prepared by uniformly mixing the refractory aggregate with a combination of the water glass and carbonates and/or borates, and held within the forming mold heated to the temperature of 120-200° C., so that the effect of improvement of the moisture resistance is achieved. The reason for this improvement is examined as follows. First, in the case where the molding material mixture in the wet state is dried and solidified at a temperature lower than 120° C., the water glass contains water and is vulnerable to re-dissolution. On the other hand, heat application at a temperature not lower than 120° C. permits evaporation of water in the water glass, causing an increase of resistance of the water glass to re-dissolution to some extent. However, even the heat application at the temperature not lower than 120° C. is not sufficient: the water glass cannot avoid suffering from re-dissolution in a highly hot and humid environment, due to a large amount of alkali included in the molding material mixture. Under these circumstances, where a carbonate is added to the molding material mixture as an additive, the carbonate is subjected to thermal decomposition at a temperature of around 120° C., with a result of generation of $CO_2$. $CO_2$ permits the alkali in the vicinity of the carbonate to be neutralized, so that re-dissolution of the water glass is supposedly prevented to improve the moisture-resistant strength. Furthermore, where a borate is added to the molding material mixture as an additive, a tetraborate ion or a metaborate ion forms a chelate between the OH bonds of the water glass, as soon as the water is evaporated by heat application at the temperature not lower than 120° C. Consequently, OH of the water glass is blocked, so that re-dissolution of the molding material mixture is supposedly prevented to improve the moisture-resistant strength.

According to the first method described above, the casting mold can be formed by using the molding material mixture not in the wet state, but in the dry state. In this case, after the molding material mixture in the dry state is filled within the forming cavity of the forming mold designed to provide the desired casting mold, a step of blowing a steam is performed additionally such that the steam is passed through the filling phase of the molding material mixture. The molding material mixture which is rendered wet by passing of the steam is held within the forming mold heated to the temperature of 120-200° C. until it becomes dried. The method of producing the casting mold by passing the steam with respect to the molding material mixture in the dry state will be explained in detail in the second method described later.

Meanwhile, in the above-described first method, where the temperature of the forming mold is excessively higher than that of the steam at the time of blowing, the steam is immediately evaporated and is not subjected to condensation, so that the water glass in the vicinity of the surface of the forming mold is not dissolved, giving rise to a possibility that the forming of the casting mold may be difficult due to reduction of the surface strength. For this reason, blowing of the steam is performed at the temperature not lower than 120° C. when the molding material mixture is held within the forming mold heated to the temperature of 120-200° C. It is preferred to use the molding mixture in the wet state where the use of the steam having a considerably high temperature is not desired.

In the second method of forming the casting mold by using the molding material mixture according to the present invention, the molding material mixture in the dry state is first filled within the forming cavity of the forming mold designed to provide the desired casting mold, and then a steam is blown into and passed through the filling phase of the molding material mixture, while the molding material mixture is held within the forming mold heated to a temperature not lower than 30° C. and lower than 120° C. until it becomes dried. By heat application like this, the molding material mixture filled and held within the forming mold is subjected to solidification or curing. Then the molding material mixture is subjected to a secondary baking or heating in a thermostat heated to a temperature of 120-200° C., generally for 0.2-2 hours, preferably for 0.5-1 hour. The time period from the forming step performed in the forming cavity to the secondary baking (heating) step is not limited in particular. However, it is preferred to perform the steps within 24 hours, more preferably 2 hours, so as to stabilize the physical properties of the casting mold.

As described above, the molding material mixture prepared by uniformly mixing the refractory aggregate with a combination of the water glass and carbonates and/or borates is held and formed within the heated forming mold, and then subjected to the secondary baking at the temperature of 120-200° C., so that the effect of improvement of the moisture resistance is achieved. The reason for this improvement is examined as follows. First, in the case where the molding material mixture in the dry state is dried and solidified at the temperature not lower than 30° C. and lower than 120° C., the water glass contains water and is vulnerable to re-dissolution. Then the formed casting mold is subjected to the secondary baking in the thermostat having the temperature of 120-200° C., preferably 130-180° C., and more preferably 140-160° C., so that the water in the water glass is evaporated and removed, causing an increase of resistance of the water glass to re-dissolution. By means of a combination of the above-described operation and the effect of addition of carbonates or borates as an additive, improvement of the moisture-resistant strength of the casting mold is supposedly achieved. Since the effect of addition of carbonates or borates as an additive is the same as described in the first method of producing the casting mold, an explanation of the effect is not repeated here.

After the molding material mixture in the dry state is filled within the cavity of the heated forming mold as described above, the steam is passed, under the pressure, through the filling phase formed therein by way of blowing inlets provided in the forming mold, so that the sand particles of the molding material mixture constituting the filling phase are rendered wet and bonded to each other so as to form a mass of the molding material mixture (a mass of the bonded particles of the molding material mixture) in the form of an integral casting mold.

The temperature at which the steam is blown into the forming mold by way of the blowing inlet and passed through the filling phase of the molding material mixture is generally around 80-150° C., more preferably 95-120° C. The steam at a relatively high temperature requires a large amount of energy for its production, so that the temperature of the steam not higher than 100° C. is preferred in particular. The pressure at which the steam is passed through according to the present invention is generally around 0.01-0.3 MPa, more preferably 0.01-0.1 MPa, in terms of the gauge pressure. In the case where the molding material mixture has a high degree of air permeability, the above-described degree of the gauge pressure for passing the steam permits the steam to be uniformly passed through the casting mold formed within the forming mold, while contributing to reduction of the time required for passing the steam and the time required for drying the casting mold, and consequent improvement of the speed of forming the casting mold. Furthermore, the above-described gauge pressure also permits formation of the casting mold even in the case where the molding material mixture has a low degree of air permeability. It is noted that an excessively high degree of gauge pressure results in sticking of the molding material mixture around the blowing inlet, while an excessively low degree of gauge pressure causes a risk of failure to pass the steam through the entirety of the casting mold so that the molding material mixture is not sufficiently moisturized.

The method of passing the steam as described above includes the steps of blowing the steam by way of the blowing inlets provided in the forming mold and passing the steam through the molding material mixture filled within the forming cavity of the forming mold. Furthermore, the adequate time of passing the steam is selected according to the size of the forming mold, the number of the blowing inlets and the like, so as to supply the steam to the surface of the particles of the molding material mixture, sufficiently moisturize the water glass as the binder on the surface, and bond (join) the particles of the molding material mixture to each other. In general, the length of time of passing the steam is from about two seconds up to about 60 seconds. An excessively short period of time makes it difficult to sufficiently moisturize the surface of the particles of the molding material mixture, while an excessively long period of time causes dissolution and flow-out of the binder on the surface of the molding material mixture, giving rise to a risk of occurrence of sticking to the forming mold, in addition to a problem of an increase of the length of time required for forming the mold.

A further improvement of the permeability of the steam can be achieved by sucking the atmosphere out of the forming mold through vents of the forming mold while the steam is passed. It is also effective to subject the phase of the molding material mixture filled within the forming mold to a reduced pressure in advance before passing the steam. In addition, it is important to arrange the positions of the blowing inlets and vents so as to optimize the distance of a passage of the steam through the filling phase, in order to produce a core having a complicated shape, for example. In some cases, it is effective to conduct a simulation of passing of the steam by using a plurality of blowing inlets and vents.

The forming mold within which the molding material mixture in the dry state is filled, such as a metal mold or a wooden mold, is preferably preheated and kept warm. The molding material mixture moisturized by the steam is dried while it is kept within the heated forming mold for a predetermined period of time, so that solidification or curing of the molding material mixture is expedited. The temperature at which the forming mold is kept by preheating is generally around 30-120° C., more preferably 50-110° C., and further preferably 60-100° C. An excessively high temperature at which the mold is kept makes it difficult to deliver the steam to the surface of the forming mold, resulting in deterioration of the strength of the formed casting mold, while an excessively low temperature at which the mold is kept causes an increase of the length of time required for drying the formed casting mold, so that the resin adheres to the surface of the forming mold, and the problem of sticking is likely to be caused.

Furthermore, the molding material mixture in the dry state which is filled within the above forming mold is also preferably preheated. Generally, by filling the molding material mixture heated to a temperature not lower than 30° C. within the forming mold, the flexural strength of the obtained casting mold is more advantageously improved. A heating temperature of the molding material mixture is preferably 30-100° C., and in particular the molding material mixture heated to a temperature of 40-80° C. is advantageously used.

According to the above-described second method, it is possible to use the molding material mixture in the wet state, not in the dry state. Where the molding material mixture is in the wet state, it is not required to perform the step of blowing the steam after the molding material mixture is filled within the forming cavity of the forming mold for forming the desired casting mold. The wet molding material mixture is held within the forming mold heated to the temperature not lower than 30° C. and lower than 120° C., until it becomes dried. Then the molding material mixture is subjected to the secondary baking in the thermostat heated to the temperature of 120-200° C., so that the desired casting mold is obtained.

Furthermore, in the first and second methods of producing the casting mold according to the present invention, the following method is advantageously selected. Namely, while the wet molding material mixture is held within the heated forming mold (in the case of the dry molding material mixture, the steam is passed through the dry molding material mixture held within the forming mold so as to change it into the wet molding material mixture), the wet molding material mixture is subjected to blowing and passing of a dry air, a heated dry air, a superheated steam or a nitrogen gas into its filling phase, so as to expedite its drying. Passing of the dry air, heated dry air, superheated steam or nitrogen gas permits quick drying of even the inner portion of the filling phase of the molding material mixture, so as to more advantageously promote solidification or curing of the filling phase and advantageously increase the curing speed, further contributing to an effective improvement of the flexural strength and other properties of the obtained casting mold and reduction of the time required for forming the casting mold. Preferably, the heated dry air or the superheated steam is passed through the filling phase for promotion of its drying.

Furthermore, while the molding material mixture is held within the heated forming mold as described above, a predetermined gas like a reactive gas such as a carbon dioxide (carbonic acid gas) and ester, or an inert gas such as nitrogen and argon, may be passed through the molding material mixture. Passing of the gas permits neutralization of the binder, so as to further promote its solidification or curing. It is noted that it is completely acceptable to perform the passing of the gas while the steam, the dry air or the like is passed.

EXAMPLES

To clarify the present invention more specifically, some examples of the present invention will be described. However, it is to be understood that the present invention is by no means limited by the details of the illustrated examples. In the examples and comparative examples described below, "part" and "%" respectively indicate "part by mass" and "% by mass", unless otherwise specified. Measurement of a flexural strength of casting molds obtained by using the molding mixture of the examples and comparative examples is performed as follows.

—Measurement of the Flexural Strength—

With respect to samples obtained by using each CS, its breaking load was measured by using a measuring device (a digital molding sand strength tester available from Takachiho Seiki Co., Ltd., Japan). The flexural strength was calculated from the measured breaking load according to the following formula. It is noted that the flexural strength was measured in a cold state after the formation of the sample (1 hour after the formation of the sample).

$$\text{Flexural strength}=1.5\times LW/ab^2$$

[L: length (cm) of a support span, W: breaking load (kgf), a: width (cm) of the sample, b: thickness (cm) of the sample]

—Measurement of the Flexural Strength Upon Moisture Absorption (24 h)—

The obtained samples were put into a thermohygrostat having a temperature of 30° C. and a humidity of 80%, and held therein for 24 hours. Then, the samples were taken out of the thermohygrostat and measured of their flexural strength values within 10 minutes according to the above-described test method.

Production Example 1

(CSI) of the Molding Material Mixture in the Wet State

A commercially available artificial molding sand LUNAMOS #50 (Trade Name; available from Kao Corporation, Japan) was prepared as a refractory aggregate. An aqueous solution of a water glass was prepared by diluting commercially available sodium silicate No. 3 (Trade Name; available from Fuji Kagaku Corp., Japan, molar ratio $SiO_2/Na_2O$: 3.0) used as a binder, with water, such that the aqueous solution of the water glass has a nonvolatile content (an amount of a portion of the aqueous solution except the water contained therein) of 25.6%.

Subsequently, a Shinagawa-shiki universal mixer (5DM-r type; manufactured by Dalton Co., Ltd., Japan) was charged with the LUNAMOS #50 having a temperature of 20° C., and the above-described aqueous solution of the water glass was introduced into the mixer in an amount of 0.5 part, in terms of its solid content calculated on the basis of only the nonvolatile portion, with respect to 100 parts of the LUNAMOS #50. Further, zinc carbonate was added in an amount of 5 parts with respect to 100 parts of the solid content of the aqueous solution of the water glass, and the contents in the mixer were kneaded for 30 seconds. After the contents were stirred and mixed until an aggregate structure of the sand particles collapsed, the contents were taken out of the mixer, whereby a wet molding material mixture (CS1) having free flowing characteristics at the room temperature was obtained.

Production Example 2

(CS2) of the Molding Material Mixture in the Wet State

CS2 was obtained by the same procedure as in the Production Example 1, except that zinc carbonate in the Production Example 1 was added in an amount of 3 parts with respect to 100 parts of the solid content of the water glass.

Production Example 3

(CS3) of the Molding Material Mixture in the Wet State

CS3 was obtained by the same procedure as in the Production Example 1, except that zinc carbonate in the Production Example 1 was added in an amount of 10 parts with respect to 100 parts of the solid content of the water glass.

Production Example 4

(CS4) of the Molding Material Mixture in the Wet State

CS4 was obtained by the same procedure as in the Production Example 1, except that ferrous carbonate (II) was used in place of zinc carbonate used in the Production Example 1, in an amount of 5 parts with respect to 100 parts of the solid content of the water glass.

Production Example 5

(CS5) of the Molding Material Mixture in the Wet State

CS5 was obtained by the same procedure as in the Production Example 1, except that sodium tetraborate decahydrate was used in place of zinc carbonate used in the Production Example 1, in an amount of 5 parts with respect to 100 parts of the solid content of the water glass.

Production Example 6

(CS6) of the Molding Material Mixture in the Wet State

CS6 was obtained by the same procedure as in the Production Example 1, except that potassium metaborate was used in place of zinc carbonate used in the Production Example 1, in an amount of 5 parts with respect to 100 parts of the solid content of the water glass.

Production Example 7

(CS7) of the Molding Material Mixture in the Wet State

CS7 was obtained by the same procedure as in the Production Example 1, except that zinc carbonate used as the additive in the Production Example 1 is not added.

Production Example 8

(CS8) of the Molding Material Mixture in the Dry State

A commercially available artificial molding sand LUNAMOS #50 (Trade Name; available from Kao Corporation, Japan) was prepared as a refractory aggregate. An aqueous solution of a water glass was prepared by adding sodium hydroxide to commercially available sodium silicate No. 3 (Trade Name; available from Fuji Kagaku Corp., Japan, molar ratio $SiO_2/Na_2O$:3.0) used as a binder component, such that the molar ratio is 2.3, and by diluting it with water, such that the aqueous solution of the water glass has a nonvolatile content (an amount of a portion of the aqueous solution except the water contained therein) of 25.6%.

Subsequently, a kneader (speed muller; manufactured by Enshu Tekko Kabushiki Kaisha, Japan) was charged with the LUNAMOS #50 heated to a temperature of 140° C., and the above-described aqueous solution of the water glass was introduced into the kneader in an amount of 0.5 part in terms of its solid content calculated on the basis of only the nonvolatile portion, with respect to 100 parts of the LUNAMOS #50. Further, zinc carbonate was added in an amount of 5 parts with respect to 100 parts of the solid content of the aqueous solution of the water glass, and the contents in the kneader were kneaded for 1 minute so as to evaporate the water. After the contents were stirred and mixed until an aggregate structure of the sand particles collapsed, the contents were taken out of the kneader, whereby a molding material mixture in the dry state (CS8) having free flowing characteristics at the room temperature was obtained.

Production Example 9

(CS9) of the Molding Material Mixture in the Dry State

CS9 was obtained by the same procedure as in the Production Example 8, except that ferrous carbonate (II) was used in place of zinc carbonate used in the Production Example 8, in an amount of 5 parts with respect to 100 parts of the solid content of the water glass.

Production Example 10

(CS10) of the Molding Material Mixture in the Dry State

CS10 was obtained by the same procedure as in the Production Example 8, except that sodium tetraborate decahydrate was used in place of zinc carbonate used in the Production Example 8, in an amount of 5 parts with respect to 100 parts of the solid content of the water glass.

Production Example 11

(CS11) of the Molding Material Mixture in the Dry State

CS11 was obtained by the same procedure as in the Production Example 8, except that zinc carbonate used as the additive in the Production Example 8 is not added.

The water content of each of the molding material mixtures CS1-CS7 in the wet state obtained as described above was 1.2%-1.5%, and the water content of each of the molding material mixtures CS8-CS11 in the dry state was 0.01%-0.15%.

<Experiment 1: The Forming Mold is Temperature-Controlled; No Secondary Baking; in the Wet State>

—Formation of the Casting Mold 1 (Example 1)—

CS1 at 20° C. obtained in the above Production Example 1 of the molding material mixture was blown into and filled within the forming mold heated to 120° C., at a gauge pressure of 0.3 MPa, and held within the forming mold for one minute and 30 seconds. Then, a hot air at 300° C. was blown into the forming mold for one minute at a gauge pressure of 0.03 MPa. The molding material mixture was held within the forming mold for 3 minutes in total after filling, so that CS1 was cured and a casting mold (Example 1) used as a sample [10 mm×10 mm×80 mm] was obtained.

—Formation of the Casting Mold 2 (Examples 2 and 3)—

The casting molds (Examples 2 and 3) were obtained by the same procedure as in the Example 1, except that CS1 at 20° C. was filled within the forming mold heated to temperatures of 150° C. and 200° C., respectively.

—Formation of the Casting Mold 3 (Examples 4-8)—

The casting molds (Examples 4-8) were obtained by the same procedure as in the Example 1, except that each of CS2-CS6 was used in place of CS1 used in the Example 1 respectively, and each of them was filled within the forming mold heated to 150° C.

—Formation of the Casting Mold 4 (Comparative Example 1)—

The casting mold (Comparative Example 1) was obtained by the same procedure as in the Example 1, except that CS7 was used in place of CS1 used in the Example 1, and CS7 was filled within the forming mold heated to 150° C.

—Formation of the Casting Mold 5 (Comparative Examples 2-4)—

The casting molds (Comparative Examples 2-4) were obtained by the same procedure as in the Example 1, except that CS1, CS5 and CS7 were used as the molding material mixture, respectively, and each of them was filled within the forming mold heated to 100° C.

According to the above-described test method, the flexural strength and the flexural strength after 24 hours of moisture absorption were measured with respect to the samples obtained in the Examples 1-8 and the Comparative Examples 1-4. The results of the measurement are shown in the following Tables 1 and 2. It is noted that the flexural strength after 24 hours of moisture absorption not lower than 15 kgf/cm$^2$ is recognized as acceptable with respect to the present Examples.

TABLE 1

| | | | Example 1 | Example 2 | Example 3 | Example 4 | Example 5 | Example 6 | Example 7 | Example 8 |
|---|---|---|---|---|---|---|---|---|---|---|
| Molding Material Mixture | | | CS1 | CS1 | CS1 | CS2 | CS3 | CS4 | CS5 | CS6 |
| Additive | | | zinc carbonate | zinc carbonate | zinc carbonate | zinc carbonate | zinc carbonate | ferrous carbonate | sodium tetraborate decahydrate | potassium metaborate |
| Amount of Additive (with respect to 100 parts of solid content of water glass) | | (part) | 5 | 5 | 5 | 3 | 10 | 5 | 5 | 5 |
| State of Sand | | | Wet | Wet | Wet | Wet | Wet | Wet | Wet | Wet |
| Temperature of Forming Mold | | (° C.) | 120 | 150 | 200 | 150 | 150 | 150 | 150 | 150 |
| Flexural Strength | Immediately after Casting Mold Formation | (kgf/cm$^2$) | 38.5 | 29.9 | 22.8 | 44.7 | 27.1 | 26.5 | 49.8 | 53.7 |
| | After 24 hrs of Moisture Absorption | (kgf/cm$^2$) | 29.0 | 30.2 | 23.4 | 43.6 | 29.0 | 28.7 | 39.4 | 50.8 |

TABLE 2

| | | | Comparative Example 1 | Comparative Example 2 | Comparative Example 3 | Comparative Example 4 |
|---|---|---|---|---|---|---|
| Molding Material Mixture | | | CS7 | CS1 | CS5 | CS7 |
| Additive | | | none | zinc carbonate | sodium tetraborate decahydrate | none |
| Amount of Additive (with respect to 100 parts of solid content of water glass) | | (part) | — | 5 | 5 | — |
| State of Sand | | | Wet | Wet | Wet | Wet |
| Temperature of Forming Mold | | (° C.) | 150 | 100 | 100 | 100 |
| Flexural Strength | Immediately after Casting Mold Formation | (kgf/cm$^2$) | 53.6 | 43.4 | 43.0 | 45.5 |

TABLE 2-continued

| | | Comparative Example 1 | Comparative Example 2 | Comparative Example 3 | Comparative Example 4 |
|---|---|---|---|---|---|
| After 24 hrs of Moisture Absorption | (kgf/cm$^2$) | 14.4 | 13.1 | 14.1 | 13.1 |

Comparing the results of the Examples 1-3 and the result of the Comparative Example 2, which are shown in Tables 1 and 2, with each other, it is recognized that the degree of the flexural strength immediately after the formation of the casting mold is the highest in the case where the temperature of the forming mold is 100° C., and decreases with an increase of the temperature. On the other hand, the degree of the flexural strength after 24 hours of moisture absorption is the highest in the case where the temperature of the forming mold is 150° C. In particular, with respect to the Comparative Example 2, the flexural strength after moisture absorption suffers from significant deterioration. The borates used in the Examples 7 and 8, as well as the carbonates in the Examples 1-6, permit an improvement of the moisture-resistant strength. This fact shows that the casting mold held in the forming mold at the temperature of 120° C.-200° C. with use of the carbonates or borates has an improved moisture-resistant strength. Meanwhile, with respect to the Examples 2, 3 and 5, the degree of the flexural strength after 24 hours of moisture absorption is higher than that immediately after the formation of the casting mold. This is because the curing proceeds during 24 hours after the formation, so that the degree of the flexural strength some time after the formation is slightly higher than that immediately after the formation. Furthermore, the deterioration of the casting mold caused by moisture absorption is prevented due to an improvement of the flexural strength after the formation, so that the flexural strength after 24 hours of moisture absorption is higher.

<Experiment 2: Subjected to the Secondary Baking; in the Dry State>

—Formation of the Casting Mold 6 (Examples 9-11)—

CS8 at 20° C. obtained in the above Production Example 8 of the molding material mixture was blown into and filled within the forming mold heated to 100° C., at a gauge pressure of 0.3 MPa. Then, a steam at 100° C. and a nitrogen gas were blown into the forming mold simultaneously for 20 seconds, at gauge pressures of 0.04 MPa and 0.2 MPa, respectively, so as to be passed through the molding material mixture filled within the forming mold. After passing of the steam was completed, a hot air at 300° C. was blown into the forming mold at a gauge pressure of 0.03 MPa for 2 minutes and 40 seconds. The molding material mixture was held within the forming mold for 3 minutes in total after filling, so that CS8 was cured, and casting molds used as samples [10 mm×10 mm×80 mm] were obtained.

Each of the thus produced samples was subjected to the secondary baking within two hours after the formation of the casting mold, for 30 minutes, within a thermostat heated to 120° C., 150° C. and 200° C., so as to obtain respective casting molds (Examples 9-11).

—Formation of the Casting Mold 7 (Examples 12 and 13)—

The casting molds (Examples 12 and 13) were obtained by the same procedure as in the Example 9, except that CS9 and CS10 were used in place of CS8 used in the Example 9, and a temperature of the secondary baking was set at 150° C.

—Formation of the Casting Mold 8 (Comparative Example 5)—

The casting mold (Comparative Example 5) was obtained by the same procedure as in the Example 9, except that a temperature of the secondary baking was set at 100° C.

—Formation of the Casting Mold 9 (Comparative Example 6)—

The casting mold (Comparative Example 6) was obtained by the same procedure as in the Example 9, except that the secondary baking was not conducted.

—Formation of the Casting Mold 10 (Comparative Example 7)—

The casting mold (Comparative Example 7) was obtained by the same procedure as in the Example 9, except that CS11 was used in place of CS8 used in the Example 9, and a temperature of the secondary baking was set at 150° C.

—Formation of the Casting Mold 11 (Comparative Example 8)—

The casting mold (Comparative Example 8) was obtained by the same procedure as in the Example 9, except that CS11 was used in place of CS8 used in the Example 9, and the secondary baking was not conducted.

According to the above-described test method, the flexural strength and the flexural strength after 24 hours of moisture absorption were measured with respect to the samples obtained in the Examples 9-13 and the Comparative Examples 5-8. The results of the measurement are shown in the following Table 3.

TABLE 3

| | | Example 9 | Example 10 | Example 11 | Example 12 | Example 13 | Comparative Example 5 | Comparative Example 6 | Comparative Example 7 | Comparative Example 8 |
|---|---|---|---|---|---|---|---|---|---|---|
| Molding Material Mixture Additive | | CS8 zinc carbonate | CS8 zinc carbonate | CS8 zinc carbonate | CS9 ferrous carbonate | CS10 sodium tetraborate decahydrate | CS8 zinc carbonate | CS8 zinc carbonate | CS11 none | CS11 none |
| Amount of Additive (with respect to 100 parts of solid content of water glass) | (part) | 5 | 5 | 5 | 5 | 5 | 5 | 5 | — | — |
| State of Sand | | Dry | Dry | Dry | Dry | Dry | Dry | Dry | Dry | Dry |
| Temperature of Forming Mold | (° C.) | 100 | 100 | 100 | 100 | 100 | 100 | 100 | 100 | 100 |

TABLE 3-continued

| | | | Example 9 | Example 10 | Example 11 | Example 12 | Example 13 | Comparative Example 5 | Comparative Example 6 | Comparative Example 7 | Comparative Example 8 |
|---|---|---|---|---|---|---|---|---|---|---|---|
| Temperature of Secondary Baking | | (° C.) | 120 | 150 | 200 | 150 | 150 | 100 | — | 150 | — |
| Flexural Strength | Immediately after Casting Mold Formation | (kgf/cm$^2$) | 36.2 | 29.6 | 18.1 | 25.3 | 35.9 | 40.7 | 23.2 | 27.3 | 24.6 |
| | After 24 hrs of moisture absorption | (kgf/cm$^2$) | 20.5 | 31.1 | 18.9 | 27.1 | 27.5 | 3.4 | 2.3 | 5.3 | 1.5 |

According to the results of the Examples 9-11 and the Comparative Example 5, which are shown in Table 3, it is recognized that the degree of the flexural strength immediately after the formation of the casting mold is the highest in the case where the temperature of the secondary baking is 100° C. and decreases with an increase of the temperature of the secondary baking. On the other hand, the degree of the flexural strength after 24 hours of moisture absorption is the highest in the case where the temperature of the secondary baking is 150° C. In particular, with respect to the Comparative Example 5, the flexural strength after moisture absorption suffers from significant deterioration. The borate used in the Examples 13, as well as the carbonates in the Examples 9-12, permits an improvement of the moisture-resistant strength. This fact shows that the casting mold subjected to the secondary baking at the temperature of 120° C.-200° C. with use of the carbonates or borates has an improved moisture-resistant strength.

<Experiment 3: Subjected to the Secondary Baking; in the Wet State>

—Formation of the Casting Mold 12 (Examples 14 and 15)—

Each of CS2 and CS5 at 20° C. obtained in the above Production Examples 1 and 5 of the molding material mixture was blown into and filled within the forming mold heated to 100° C., at a gauge pressure of 0.3 MPa, and held within the forming mold for one minute and 30 seconds. Then, a hot air at 300° C. was blown into the forming mold for one minute and 30 seconds at a gauge pressure of 0.03 MPa. The molding material mixture was held within the forming mold for 3 minutes in total after filling, so that each of CS1 and CS5 was cured, and casting molds (Examples 14 and 15) used as samples [10 mm×10 mm×80 mm] were obtained.

Each of the thus produced samples was subjected to the secondary baking for 30 minutes, within a thermostat held at 150° C., so as to obtain casting molds (Examples 14 and 15).

—Formation of the Casting Mold 13 (Comparative Example 9)—

A casting mold (Comparative Example 9) was obtained by the same procedure as in the Example 14, except that CS7 is used in place of CS1 used in the Example 14.

According to the above-described test method, the flexural strength and the flexural strength after 24 hours of moisture absorption were measured with respect to the samples obtained in the Examples 14 and 15 and the Comparative Example 9. The results of the measurement are shown in the following Table 4.

TABLE 4

| | | | Example 14 | Example 15 | Comparative Example 9 |
|---|---|---|---|---|---|
| Molding Material Mixture | | | CS1 | CS5 | CS7 |
| Additive | | | zinc carbonate | sodium tetraborate decahydrate | none |
| Amount of Additive (with respect to 100 parts of solid content of water glass) | | (part) | 5 | 5 | — |
| State of Sand | | | Wet | Wet | Wet |
| Temperature of Forming Mold | | (° C.) | 100 | 100 | 100 |
| Temperature of Secondary Baking | | (° C.) | 150 | 150 | 150 |
| Flexural Strength | Immediately after Casting Mold Formation | (kgf/cm$^2$) | 35.2 | 35.0 | 37.0 |
| | After 24 hrs of Moisture Absorption | (kgf/cm$^2$) | 30.2 | 30.8 | 17.1 |

According to the result shown in Table 4, it is recognized that the molding material mixture in the wet state, as well as the molding material mixture in the dry state referred to in Table 3, can achieve the improvement of the moisture-resistant strength.

The invention claimed is:

1. A method of producing a casting mold, wherein a molding material mixture comprising at least (a) a refractory aggregate, (b) a binder including a water glass as an essential component and (c) a carbonate and/or a borate is filled and held within a forming mold heated to a temperature of 120° C.–200° C., so that the molding material mixture is cured, and wherein the carbonate and/or the borate is used in an amount of 1-50 parts by mass with respect to 100 parts by mass of the water glass.

2. The method of producing the casting mold according to claim 1, wherein a heated air or a heated steam is passed through the forming mold while the molding material mixture is held within the forming mold.

3. The method of producing the casting mold according to claim 1, wherein the water glass comprises a sodium silicate as a major component.

4. The method of producing the casting mold according to claim 3, wherein the sodium silicate has a molar ratio $SiO_2/Na_2O$ of 1.5-4.0.

5. The method of producing the casting mold according to claim 1, wherein the carbonate is at least one of zinc carbonate, ferrous carbonate, manganese carbonate and copper carbonate.

6. The method of producing the casting mold according to claim 1, wherein the borate is at least one of sodium tetraborate, potassium tetraborate, lithium tetraborate, ammonium tetraborate, calcium tetraborate, strontium tetraborate, silver tetraborate, sodium metaborate, potassium metaborate, lithium metaborate, ammonium metaborate, calcium metaborate, silver metaborate, copper metaborate, lead metaborate and magnesium metaborate.

7. The method of producing the casting mold according to claim 1, wherein the molding material mixture is in a wet state.

8. The method of producing the casting mold according to claim 1, wherein the molding material mixture is in a dry state, and a steam is passed through a filling phase of the molding material mixture after the molding material mixture is filled within the forming mold.

9. A method of producing a casting mold, wherein a molding material mixture comprising at least (a) a refractory aggregate, (b) a binder including a water glass as an essential component and (c) a carbonate and/or a borate is filled and held within a forming mold so as to be solidified or cured, and then the molding material mixture is subjected to a secondary baking in a thermostat at a temperature of 120° C.-200° C., wherein the carbonate and/or the borate is used in an amount of 1-50 parts by mass with respect to 100 parts by mass of the water glass.

10. The method of producing the casting mold according to claim 9, wherein the forming mold is heated to a temperature in a range of 30° C. or more to less than 120° C.

11. The method of producing the casting mold according to claim 9, wherein a heated air or a heated steam is passed through the forming mold while the molding material mixture is held within the forming mold.

12. The method of producing the casting mold according to claim 9, wherein the water glass comprises a sodium silicate as a major component.

13. The method of producing the casting mold according to claim 12, wherein the sodium silicate has a molar ratio $SiO_2/Na_2O$ of 1.5-4.0.

14. The method of producing the casting mold according to claim 9, wherein the carbonate is at least one of zinc carbonate, ferrous carbonate, manganese carbonate and copper carbonate.

15. The method of producing the casting mold according to claim 9, wherein the borate is at least one of sodium tetraborate, potassium tetraborate, lithium tetraborate, ammonium tetraborate, calcium tetraborate, strontium tetraborate, silver tetraborate, sodium metaborate, potassium metaborate, lithium metaborate, ammonium metaborate, calcium metaborate, silver metaborate, copper metaborate, lead metaborate and magnesium metaborate.

16. The method of producing the casting mold according to claim 9, wherein the molding material mixture is in a wet state.

17. The method of producing the casting mold according to claim 9, wherein the molding material mixture is in a dry state, and a steam is passed through a filling phase of the molding material mixture after the molding material mixture is filled within the forming mold.

18. A casting mold produced by molding and curing a molding material mixture comprising at least (a) a refractory aggregate, (b) a binder including a water glass as an essential component and (c) a carbonate and/or a borate, wherein the molding material mixture is held within a forming mold and heated to a temperature of 120° C.-200° C. to cure the molding material mixture, and wherein the carbonate and/or the borate is used in an amount of 1-50 parts by mass with respect to 100 parts by mass of the water glass.

* * * * *